United States Patent [19]

Ostersetzer et al.

[11] 4,201,526

[45] May 6, 1980

[54] PIVOTED BLADE BETWEEN ROTOR AND STATOR HAVING ARCUATE SECTIONS

[76] Inventors: Shlomo Ostersetzer; Eugenius Brochstein, both of P.O.B. 80, Gedera, Israel

[21] Appl. No.: 856,753

[22] Filed: Dec. 2, 1977

[30] Foreign Application Priority Data

Dec. 6, 1976 [IL] Israel ..... 51049

[51] Int. Cl.[2] ..... F01C 1/00; F01C 19/00

[52] U.S. Cl. ..... 418/136; 418/259; 418/260; 418/264

[58] Field of Search ..... 418/152, 260, 264, 268, 418/136, 259

[56] References Cited

U.S. PATENT DOCUMENTS

| | | | |
|---|---|---|---|
| 18,488 | 10/1857 | Pease | 418/260 |
| 1,012,642 | 12/1911 | Hughes | 418/264 |
| 1,138,481 | 5/1915 | Hupe | 418/264 |
| 1,161,165 | 11/1915 | Smith | 418/264 |
| 1,458,361 | 6/1923 | Ruttledge | 418/136 |
| 1,685,003 | 9/1928 | McElrath | 418/268 |
| 1,858,681 | 5/1932 | Olson | 418/268 |
| 1,877,250 | 9/1932 | Meyer | 418/268 |
| 3,162,141 | 12/1964 | Vlachos | 418/152 |
| 3,873,249 | 3/1975 | Rao | 418/152 |

FOREIGN PATENT DOCUMENTS

| | | | |
|---|---|---|---|
| 1904966 | 12/1970 | Fed. Rep. of Germany | 418/268 |
| 37664 | 10/1930 | France | 418/264 |
| 1094280 | 12/1954 | France | 418/260 |
| 434660 | 4/1948 | Italy | 418/260 |

*Primary Examiner*—John J. Vrablik

*Attorney, Agent, or Firm*—Silverman, Cass & Singer, Ltd.

[57] ABSTRACT

An improved rotor blade arrangement pivotally mounted in a cylindrical recess in the rotor. The blade arrangement is pivotally mounted on a blade support and has a center of gravity offset from the pivot mounting. The arrangement includes a pair of arcuate sections joined at a blade tip, which tip seals against the stator. Each arcuate section has a free end opposite the blade tip including a linear seal contacting the recess surface. The resulting arrangement minimizes the friction loses of the blade arrangement and forms a sealed space between the recess surface and the blade profile to enhance the compression ratio for compressible fluids.

2 Claims, 3 Drawing Figures

PIVOTED BLADE BETWEEN ROTOR AND STATOR HAVING ARCUATE SECTIONS

The present invention concerns a method for sealing off in the radial direction a volume of fluid bound between a stator and a rotor and an arrangement for carrying out said method.

Machines in which a volume of fluid, gas or liquid, while contained between a radially slotted rotor, stator and suitable end plates, is forced to compress or expand under the motion of a sliding vane (or vanes) moving freely in the rotor slot (or slots), are well known. Examples of such machines are several types of gas compressors and hydraulic pumps.

Inherent in sliding vane machinery design are, however, several difficulties. The first is having to control carefully the tip contact of the vane with the inner contour of the stator in order to eliminate both leakage and extensive friction. The second difficulty involves the friction between the vane and the slot within which it is sliding. Even when operating under no-load conditions, centrifugal and Coriolis-derived forces cause considerable friction of this kind. When load is applied and a pressure differential develops across the vane, this effect is, of course, strongly enhanced. Thirdly, the transverse motion of the vane between the end plates causes friction and considerable leakage. Here, it has to be borne in mind that one "full gap" (between vane and one end plate) leads to larger leakage losses than two "half gaps" (between vane and end plates at either side).

The combination of these difficulties dictates the use of vanes which are rather massive so as to withstand the severe bending stresses imposed upon them, and which have excellent friction and wear characteristics over their entire body. This naturally tends to reduce machine efficiency and considerably increases manufacturing complexity.

It is the object of the present invention to overcome those difficulties and to replace the known sliding vane arrangement by an arrangement which does away with most of the above mentioned disadvantages.

The invention consists in a method for sealing off in the radial direction a volume of fluid contained between a stator shell and a rotor rotating within it by means of a blade pivotted around an axis not passing through the center of gravity of said blade to a support mounted in said rotor and extending between it and said stator shell, the axis of said pivot being parallel to the axis of the said stator and said rotor.

The invention further consists in an arrangement for carrying out said method, comprising a cylindrical recess within said rotor, a blade of arcuate profile pivotally mounted on a support within said recess along the axis of symmetry thereof, and a linear seal between said blade and said rotor.

Figure 1:
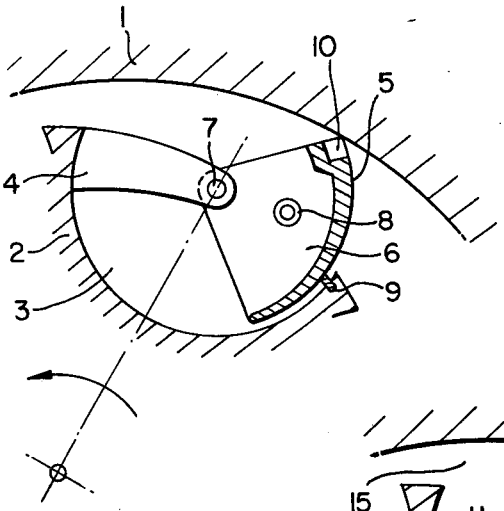
Figure 2:
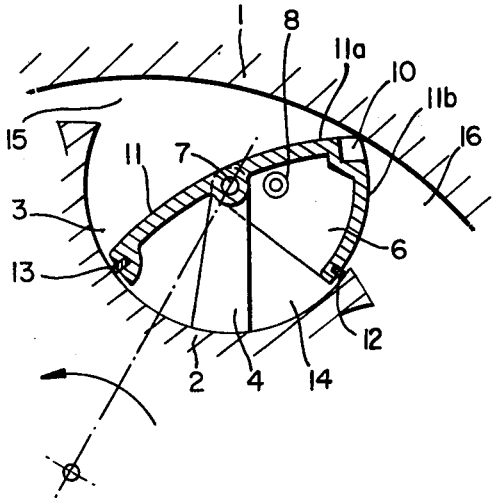
Figure 3:
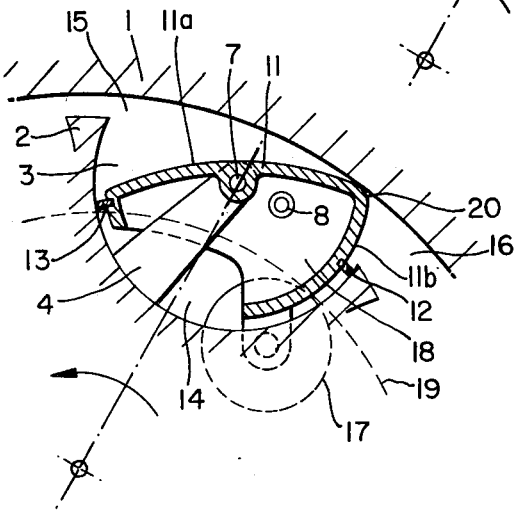

The invention is illustrated, by way of example only, in the accompanying drawings in which:

FIGS. 1–3 are schematic cross sections of three different embodiments of an arrangement according to the invention.

The arrangement according to FIG. 1 comprises a stator 1 and a rotor 2 in which the cylindrical recess 3 has been provided. Within recess 3 a support 4 is provided. A blade 5 of arcuate profile and having an integral web 6 is pivotally mounted thereby at 7 to the support 4, the center of gravity of the blade indicated at 8 being offset relative to the axis of pivot 7, said axis being parallel to the cylindrical axis of stator 1 and rotor 2. A linear seal 9 is provided between the blade 5 and the rotor 2. Said seal is made of a material having low friction and good wear characteristics relative to the material of the blade. The blade tip 10 is likewise made of a material having a low friction and good wear ability relative to the material of stator 1. Said tip may be made as an insert in blade 5 or the entire blade 5 may be made of the same material. The geometry of the arcuate section of the blade is such that the resultant of any or all uniform forces acting normal to the surface of the blade at any point thereof will pass through the pivotal axis. Hence, the effect of the forces induced by unbalanced pressures is cancelled. This construction is well suited for non-compressible fluid applications.

In FIG. 2 like parts are referenced with the same reference numeral. In this embodiment a blade 11 is made of two arcuate sections 11*a* and 11*b* which merge into each other and form a composite profile. Linear seals 12 and 13 are provided at the line of contact with the rotor 2 at the end of sections 11*a*, 11*b* respectively, so that the space 14 between blade 11 and the cylindrical recess 3 of the rotor is sealed off from the space 15, 16 between rotor 3 and the stator 1. This construction is particularly suited for gas volumetric machines in which a compression or expansion process is performed, since the trapped volume, i.e. that contained in space 14 does not participate in the process, thereby allowing for high compression (or expansion) ratios.

In the embodiment of the arrangement shown in FIG. 3 in which the parts which are the same as those in FIGS. 1 and 2 have been denoted with the same reference numerals, the composite blade 11*a*, 11*b* is provided with rollers 17 attached to its webs 18 provided at both ends thereof. A suitable cam track 19 provided in the end plates (not shown) of the stator guides the motion of the rollers 17 and thereby governs the distance between the tip 20 of the blade and the stator 1, so that no friction occurs.

We claim:

1. An improved blade arrangement for sealing off in the radial direction a volume of fluid contained between a stator shell and a rotor rotating within said shell having an axis of rotation, said improved blade arrangement comprising:

said rotor including a recess having a cylindrical surface opening between said rotor and said shell;

a blade support mounted in said rotor recess and having a blade pivot end between said surface and said stator shell; and blade means pivotally mounted on said blade support pivot end around an axis substantially parallel to said rotor axis, said blade means having a center of gravity offset from said blade pivot axis, said blade means including a first and second arcuate section joined at a first end at a blade tip to form a composite profile, each arcuate section having a second free end, said blade tip contacting said stator shell and each said free end incuding a linear seal contacting said recess surface to form a sealed space between said blade profile and said recess surface wherein the resultant of all uniform forces acting normal to the surface of said blade profile at each point thereof, passes through said blade pivot axis.

2. An improved blade arrangement as claimed in claim 1 wherein:

said first arcuate section has a length greater than said second arcuate section, said first and second sections are connected by an integral web and said blade means is pivotally mounted on said first arcuate section.

* * * * *